United States Patent [19]

Johnson et al.

[11] Patent Number: 4,879,882

[45] Date of Patent: Nov. 14, 1989

[54] JEWELRY WITH INTERCHANGEABLE ELEMENTS

[75] Inventors: Robert P. Johnson; Janice A. Johnson, both of Glendale, Ariz.

[73] Assignee: RPJ Development Corporation, Phoenix, Ariz.

[21] Appl. No.: 232,109

[22] Filed: Aug. 15, 1988

[51] Int. Cl.[4] ..... A44C 5/02

[52] U.S. Cl. ..... 63/4; 63/13; 63/20

[58] Field of Search ..... 63/4, 1.1, 2, 12, 13, 63/20, 21, 22

[56] References Cited

U.S. PATENT DOCUMENTS

| | | | |
|---|---|---|---|
| 1,710,734 | 4/1929 | Johnson | 63/13 |
| 1,782,223 | 12/1930 | Diner | 63/20 |
| 1,899,165 | 2/1933 | Rivet | 63/2 |
| 2,677,901 | 5/1954 | Tilleman | 63/4 X |
| 3,526,103 | 9/1970 | Lieber | 63/2 |
| 4,353,225 | 10/1982 | Rogers | 63/13 |

FOREIGN PATENT DOCUMENTS

| | | | |
|---|---|---|---|
| 788110 | 7/1935 | France | 63/20 |
| 3461 | of 1862 | United Kingdom | 63/20 |
| 5842 | of 1893 | United Kingdom | 63/20 |
| 260922 | 11/1926 | United Kingdom | 63/13 |

*Primary Examiner*—Kenneth J. Dorner
*Assistant Examiner*—Laurie K. Cranmer
*Attorney, Agent, or Firm*—Macdonald J. Wiggins

[57] ABSTRACT

A jewelry pendant device includes a vertical square stem having an open loop at an upper end and a retainer at the lower end. A plurality of decorative beads is threaded on the stem to fill the space between the retainer and the open loop. Releasing the retainer permits interchange of the beads to customize the pendant for the wearer. The beads may be cubical and may have letters or symbols on the faces thereofo. The open loop may be attached to ear hooks or clips, bracelets, necklaces, pins or the like to permit the pendant to be worn.

18 Claims, 2 Drawing Sheets

JEWELRY WITH INTERCHANGEABLE ELEMENTS

BACKGROUND OF THE INVENTION

1. Field of the Invention

The present invention relates to jewelry and more particularly to a pendant in which decorative elements thereof are interchangeable by the wearer.

2. Description of the Prior Art

The use of personalized jewelry is quite popular. However, the cost of custom made jewelry prevents many persons from obtaining jewelry having special initials, colors, or other elements. There is a need for jewelry designs in which decorative elements thereof can be easily changed by the wearer to provide a personalized appearance. For example, colors could be changed to match the costume being worn. Similarly, letters and symbols could be changed to make statements.

It is known to provide an earring with interchangeable beads as disclosed in Lalieu, U.S. Pat. No. 4,259,850. A depending chain is used which must be threaded through a wearer's pierced ear. Berry et al., in U.S. Pat. No. 4,534,185, disclose an earring with message cards that can be changed while Douglas, in U.S. Pat. No. 3,533,247, teaches a chain type earring in which various ornaments may be installed.

Other related U.S. patents include: Johansson, U.S. Pat. No. 3,898,754 and Barr, U.S. Pat. No. Des. 265,894.

SUMMARY OF THE INVENTION

The invention is a decorative jewelry pendant device having a rigid vertically oriented hollow stem with a clutch-type retainer attached to the lower end thereof. A cylindrical rod is insertable through the stem with the lower end thereof being gripped by the clutch-type retainer. The rod is formed into an open end loop at the upper ed thereof. The stem may have a rectangular or polygonal cross section such that decorative beads having a complementary opening therethrough may be threaded thereon, the beads thereby being prevented from rotating.

The beads may be of any desired decorative appearance. For example, cubical beads may have the exposed faces thereof decorated with initials, symbols or other devices. Such ornamentation may be engraved, embossed or appliqued on the faces.

To customize the pendant, the retainer is released and the rod withdrawn. Selected beads are then threaded on the stem. The open loop end of the rod is attached to a desired jewelry element, such as ear clips or wires, a bracelet, a necklace, an anklet, or to a pin for attachment to clothing. The rod is reinserted through the stem into the clutch type retainer to the point that the rod loop bears against the top bead.

The beads may have any desired decorative appearance. In one embodiment, beads may have letters, numerals, or symbols embossed or engraved on faces thereon and arranged to present messages, monograms, or the like.

As will now be recognized, a jewelry pendant has been disclosed which can be personalized by the wearer by installing beads of selected design, and which may be worn in a variety of ways.

It is therefore a principal object of the invention to provide a pendant, with interchangeable decorative elements, that may be worn as an earring, a bracelet, an anklet, a necklace, or a pin.

It is yet another object of the invention to provide a pendant having a vertical stem portion upon which beads or the like may be threaded wherein the beads have letters or symbols on faces thereof and which are maintained in a selected orientation.

These and other objects and advantages of the invention will be apparent from the following detailed description when read in conjunction with the drawings.

DETAILED DESCRIPTION OF THE PREFERRED EMBODIMENT

Figure 1:
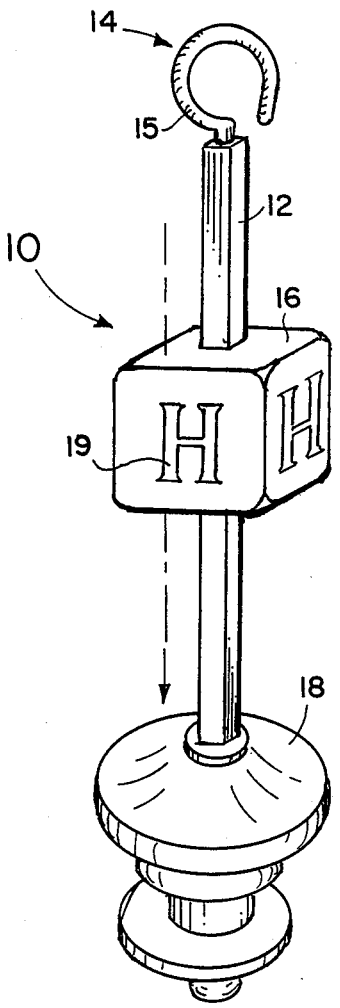
FIG. 1 is a perspective view of a pendant in accordance with the invention.
Figure 2:
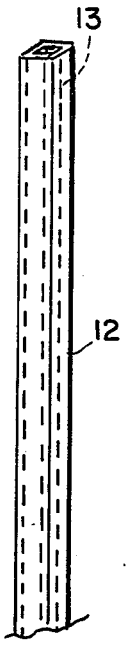
FIG. 2 is a perspective view of a square hollow stem of the pendant of 1.
Figure 3:
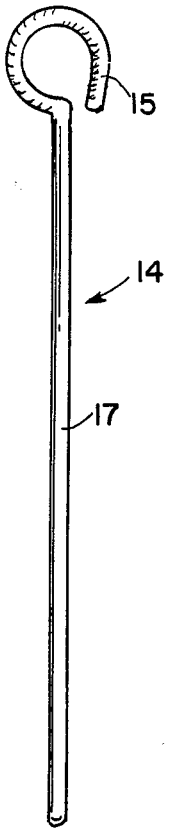
FIG. 3 is a plan view of a stem rod of the pendant of FIG. 1.

Referring to FIG. 1, a perspective view of a jewelry pendant 10 in accordance with the invention is shown. A hollow rectangular stem 12 is provided having a longitudinal rectangular opening 13 therethrough as shown in FIG. 2. A cylindrical stem rod 14 having an open loop 15 at one end thereof is inserted through opening 13 and extends for a short distance from the lower end of stem 12. A retainer 18, attached to the lower end of stem 12, receives and grips the lower end of rod 14 when passed through stem 12. Retainer 18 may be a pull-release clutch as is used with tie tacks and the like.

Figure 4:
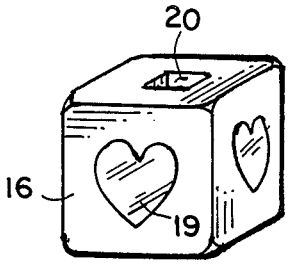
FIG. 4 is a perspective view of a typical bead of FIG. 1 having an initial on the faces thereof.

Prior to installing rod 14 through stem 12, a plurality of beads, each having an opening 20 therethrough as seen in FIG. 4, is disposed on stem 12. It is preferred that opening 20 form a sliding fit along stem 12 such that bead 16 remains in its original orientation. Beads 16 are free to slide along stem 12 as indicated by the arrow in FIG. 1. A single bead 16 is shown in FIG. 1. As an example, additional beads are installed to fill the stem as may be noted in FIG. 8. It may also be noted from FIG. 8 that the terminal end of loop 15 of stem rod 14 will bear against the top surface 35 of top bead 36, closing the gap therein which will lock pendant 10 in openings 32. Thus, the pendant 10 can be locked to any desired type of clip, hook or other jewelry attachment as discussed below.

Beads 16, shown as cubes in the examples, may have any desired shape. The cubical bead 16 provides faces upon which various symbols 19 may be placed, such as letters as in FIG. 1 and hearts as in FIG. 4. In accordance with the invention, the user may, at time of wearing, personalize or customize the pendant by releasing retainer 18, removing rod 14, and placing any desired color, shape, or design of beads 16 on stem 12, and thereafter reinserting rod 14 through stem 12 and into retainer 18. Initials, names, or similar messages may be displayed. Colors of beads may be selected to match the wearer's ensemble.

Figure 6:
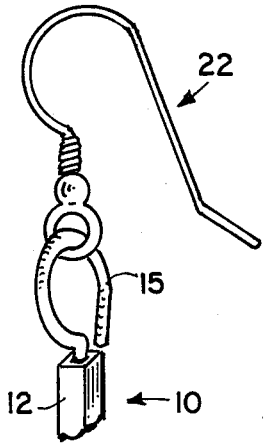
FIG. 6 is a perspective view of an ear wire hook attached to the upper end the pendant of FIG. 1.
Figure 7:
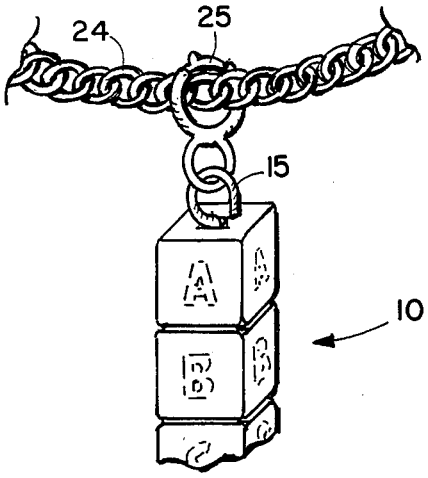
FIG. 7 a view of the pendant of FIG. 1 attached to a necklace.

Jewelry pendant 10 may be worn in a number of forms. In FIG. 6, an earring clip or french hook 22 for pierced ears is connected to loop 15 for earring use. Similarly, earring clasps may be attached to loop 15 for nonpierced ears. FIG. 7 shows loop 15 of pendant 10 attached by a spring ring 25 to a necklace or chain 24.

Figure 8:
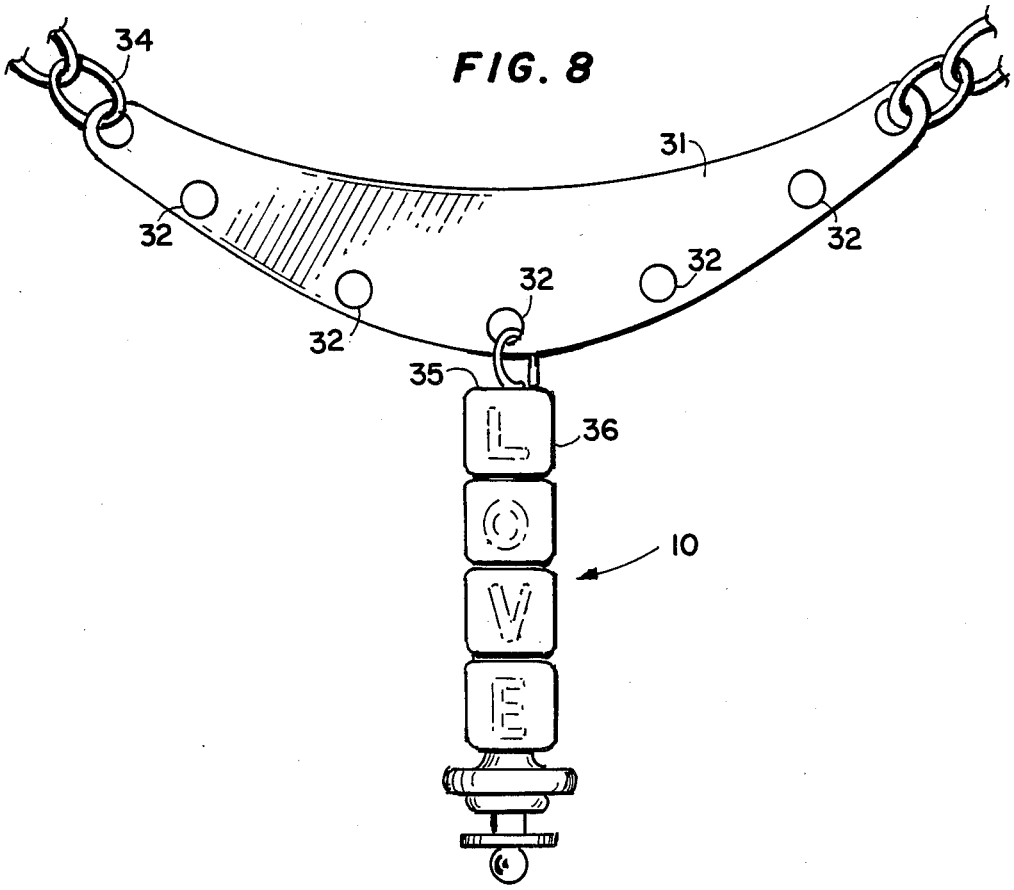
FIG. 8 a view of the pendant attached to a necklace which will accommodate a plurality of pendants.

A special necklace for use with pendant 10 is illustrated in FIG. 8 having a front plate 31 and neck encircling chain 34. Front plate 31 includes a plurality of openings 32. An exemplary pendant 10 is shown installed in center opening 32. Additional pendants 10 may be attached to front plate 31 using the other openings 32. As may be recognized, beads may be installed to form messages or patterns, as desired using one pendant, or several pendants in combination.

Figure 5:
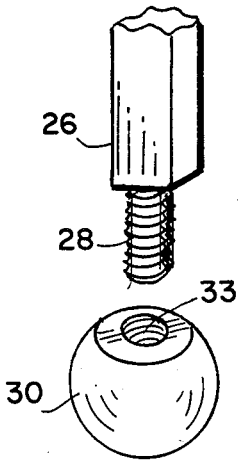
FIG. 5 is a perspective view of an alternative retainer design for the pendant.

Although a preferred embodiment of the invention has been shown, this is for exemplary purposes only, and various alternative arrangements are possible. An alternative retainer approach is to use a solid stem 26 having a threaded lower end thereof and to utilize an internally threaded attachment such as ball 30 having internal threads 33 as seen in FIG. 5. Loop 15 is formed in the upper end of stem 26. Beads 16 are threaded from the bottom of stem 26. Although the stem 12 and 26 and openings 20 in beads 16 are preferably square, other shapes are possible which will maintain beads 16 aligned. For example, the stem may be cylindrical with a keyway to match a key in the beads. All such variations are considered to fall within the spirit and scope of the invention.

We claim:

1. A jewelry pendant having interchangeable decorative elements comprising:

a vertical stem portion having a noncircular cross section, an upper end and a lower end, said upper end including a loop having a gap therein;

a plurality of beads, each having at least one flat face and an opening therethrough of said noncircular cross section to permit threading said beads on said stem portion in which an uppermost one of said beds serves to close said gap of said loop; and clutch removably attachable to said lower end means for selectively retaining said beads on said stem portion.

2. The pendant as recited in claim 1 in which said cross section is rectangular.

3. The pendant as recited in claim 1 in which each of said beads includes indicia on at least said flat face.

4. The pendant as recited in claim 3 in which said indicia are letters.

5. The pendant as recited in claim 1 in which said stem portion includes:

a hollow rectangular tube; and a cylindrical rod having said open loop formed in an upper end thereof.

6. The pendant as recited in claim 5 in which said clutch means comprises a pull-release clutch retainer for. gripping the lower end of said rod.

7. The pendant as recited in claim 6 in which said retainer is attached to a lower end of said rectangular tube.

8. The pendant recited in claim 1 in which:

said beads have an essentially cubical shape.

9. The pendant as recited in claim 1 in which said open loop is connected to means for using said pendant as an earring.

10. The pendant as recited in claim 1 in which said open loop is connected to means for using said pendant as an element of a necklace.

11. The pendant as recited in claim 11 in which said means includes:

an essentially horizontally oriented elongate front plate having a plurality of holes along a lower edge thereof, said holes for receiving the open loop of a plurality of said pendants; and a neck chain having ends thereof attached to left and right ends of said front plate to form said necklace.

12. The pendant as recited in claim 1 in which said open loop is connected to means for using said pendant as a bracelet.

13. The pendant as recited in claim 1 in which said stem portion is a rectangular bar having said open loop formed in an upper end thereof and a lower end thereof includes a threaded stud; and said clutch means is a knob element having internal threads for engaging said stud.

14. A jewelry pendant having interchangeable decorative elements comprising:

a vertically oriented hollow rectangular stem;

a cylindrical rod inserted in said stem, said rod having an open loop at an upper end thereof, the lower end of said rod projecting from a lower end of said stem;

a plurality of generally cubical beads, each having a vertical rectangular opening therethrough, said beads threaded on said stem to thereby extend from said stem lower end to said open loop, an upper face of the uppermost one of said beads closing said open loop; and a pull-release clutch retainer attached to said projecting rod and contacting said lower end of said stem for retaining said beads on said stem.

15. The pendant as recited in claim 14 in which at least one of said beads includes a symbol on at least one face thereof.

16. The pendant as recited in claim 15 in which said symbol is a letter.

17. The pendant as recited in claim 14 in which adjacent faces of said cubical beads includes letters thereon.

18. The pendant as recited in claim 17 in which said letters produce a message.

* * * * *